US006470640B2

(12) United States Patent
Ytterberg

(10) Patent No.: US 6,470,640 B2
(45) Date of Patent: Oct. 29, 2002

(54) REINFORCED SHRINKAGE COMPENSATING CONCRETE SLAB STRUCTURE

(75) Inventor: Carl N. Ytterberg, Evergreen, CO (US)

(73) Assignee: Kalman Floor Company, Evergreen, CO (US)

( * ) Notice: Subject to any disclaimer, the term of this patent is extended or adjusted under 35 U.S.C. 154(b) by 0 days.

(21) Appl. No.: 09/984,067

(22) Filed: Oct. 26, 2001

(65) Prior Publication Data

US 2002/0050110 A1 May 2, 2002

Related U.S. Application Data

(60) Provisional application No. 60/243,282, filed on Oct. 26, 2001.

(51) Int. Cl.[7] ..... E04C 2/06
(52) U.S. Cl. ..... 52/414; 52/223.6
(58) Field of Search ..... 52/414, 223.6, 52/432, 740.3, 742.14, 740.1, 677, 659

(56) References Cited

U.S. PATENT DOCUMENTS

| | | | | |
|---|---|---|---|---|
| 1,559,837 A | | 11/1925 | Allen | |
| 2,035,007 A | | 3/1936 | Workman | 72/15 |
| 3,036,356 A | | 5/1962 | Greulich | 25/154 |
| 3,222,835 A | | 12/1965 | Francis | 52/223 |
| 3,319,386 A | | 5/1967 | Francis | 52/224 |
| 3,455,069 A | | 7/1969 | Keyes | 52/73 |
| 3,513,609 A | | 5/1970 | Lang | 52/230 |
| 3,710,526 A | | 1/1973 | Parks | 52/223 |
| 4,359,848 A | * | 11/1982 | Haeussler | 428/119 |
| 4,394,201 A | * | 7/1983 | Haeussler | 156/242 |
| 4,432,175 A | | 2/1984 | Smith | 52/224 |
| 4,991,248 A | * | 2/1991 | Allen | 14/73 |
| 5,283,996 A | | 2/1994 | Myers | 52/223.6 |
| 5,875,595 A | | 3/1999 | Smith | 52/223.6 |

FOREIGN PATENT DOCUMENTS

JP 5-267880 * 5/1993

* cited by examiner

*Primary Examiner*—Robert Canfield
(74) *Attorney, Agent, or Firm*—Dykema Gossett PLLC

(57) ABSTRACT

A reinforced concrete building structure comprises a shrinkage compensating concrete slab having a plurality of deformed reinforcing bars embedded therein, the bars being restricted to a peripheral portion of the slab which surrounds the centroid of the slab devoid of reinforcement and are aligned with the expansive and shrinkage forces to elastically restrain the forces and to thereby act as an internally developed tension ring.

9 Claims, 2 Drawing Sheets

REINFORCED SHRINKAGE COMPENSATING CONCRETE SLAB STRUCTURE

RELATED APPLICATION

This application claims priority based on provisional application No. 60/243,282, filed Oct. 26, 2001.

BACKGROUND OF THE INVENTION

This invention relates to a reinforced concrete building structure, and more particularly to such structure as comprising a shrinkage compensating concrete wherein active expansive and shrinkage forces accumulate to the peripheral portion of the slab additively further from its centroid. The reinforcing bars are restricted to the peripheral portion and are aligned with the expansive and shrinkage forces.

Shrinkage compensating concrete is often referred to as "self-stressing concrete" and to "chemically prestressed concrete." Unlike traditional Portland cement based concrete, the shrinkage compensating concrete has a constituent that actively causes the concrete to volumetrically enlarge. The American Concrete Institute, ACI, defines shrinkage compensating concrete as "a concrete that, when strained by reinforcement or other means, expands . . . [and] ideally, a residual expansion will remain in the concrete, thereby eliminating shrinkage cracking." The restraint of shrinkage compensating concrete is elemental to its function.

Unlike prestressed concrete and post-tensioned concrete where the concrete is passive and the restraint actively acting upon the concrete from either pre- or post-tensioning the reinforcement, shrinkage compensating concrete generates its own expansive forces which, in turn, tension the reinforcement. ACI expounds on restraint as "a resilient type of restraint, such as that provided by internal reinforcement shall be provided to develop shrinkage compensation. Other types of restraint, such as adjacent structural elements, sub-grade friction, and integral abutments are largely indeterminate and provide either too much or too little restraint."

While industry guidelines are definitive about the amount of reinforcement required to restrain shrinkage compensating concrete slabs, by way of an amount of steel by cross-sectional area of concrete, the configuration of restraint is left largely to the specifier, except to recommend wire mesh and deformed reinforcing bar, two-way reinforcement, parallel and perpendicular to any given side of the slab.

Related technology as set forth in prior art patents are for passive concrete and active compression. Thus, the reinforcements of prior art reinforced concrete slabs are purposed for imposing an externally generated force upon a shrinking concrete. More specifically, U.S. Pat. No. 1,559,837 relates to prestressing a wheel frame on posts so as to generate a compressive force against the concrete.

U.S. Pat. No. 2,035,007 provides a structure in which the rotation of the stress is primarily of a general master rotation within which there is auxiliary rotation of subdivided circular areas producing circumferential stress bands area alternating between compressive stresses in the alternative bands.

U.S. Pat. No. 3,036,356 discloses a method of producing prestressed concrete slabs by perimeter and diagonal bands of pretensioned cables acting in concert upon a traditional concrete.

U.S. Pat. No. 3,222,835 discloses prestressing concrete by producing unique stresses between a central area and the peripheral of the slab. The stress is along a radial cable system and intended to provide concentric force.

U.S. Pat. No. 3,513,609 discloses a post-tensioning concrete for developing a concentric compressive force.

U.S. Pat. No. 3,710,526 discloses pre-tensioning concrete to develop compressive force, an annular compressive beam, inside a slab by a radial ring of tensioning cables.

U.S. Pat. No. 3,455,069 discloses a roof structure comprised of a traditional concrete with two interconnected tension rings connected by radial tension bars. The resultant self-supporting, self-resistant traditional loads roof structure relies upon rings to impose force by means of connected radial tension bars.

U.S. Pat. No. 4,432,175 discloses a slab having an internal post-tensioning cable about its centroid. The cable, however, relies upon an external force applied to the cable able to slip inside of a sheath.

U.S. Pat. No. 5,283,996 discloses an interlocking ground cover where a prestressed concrete slab is made by relying upon a molding frame assembly comprised of posts including a central ring and diagonal tensioning reinforcement.

U.S. Pat. No. 5,875,595 discloses a post-tensioning system for a prefabricated building panel where a slab is peripherally and centrally confined by a single post-tensioning cable of sufficient diameter and tensioning force to essentially apply a concentric compressive force.

SUMMARY OF THE INVENTION

It is an object of the present invention to provide bar reinforcement for a shrinkage compensating concrete slab with the reinforcing bars aligned with the expansion and shrinkage forces normally concentrated in the peripheral portion of the slab to thereby elastically restrain the forces acting as an internally developed tension ring and to maximize the efficiency of the reinforcement.

In carrying out this objective, a plurality of non-post-tension and non-pre-tensioned, deformed reinforcing bars are embedded within the concrete slab and are restricted to the peripheral portion of the slab such that the centroid slab portion is completely devoid of any reinforcement bars.

The reinforcing bars are uniformly spaced apart and lie in an array of many possible configurations, such as concentric circles, radiating bars, a combination of radiating bars and concentric circles, concentric rectangles, concentric rectangles having chamfered corners, bars lying parallel and perpendicular to one another, etc.

Other objects, advantages and novel features of the invention will become more apparent from the following detail description of the invention when taken in conjunction with the accompanying drawings.

DETAIL DESCRIPTION OF THE INVENTION

Figure 1:
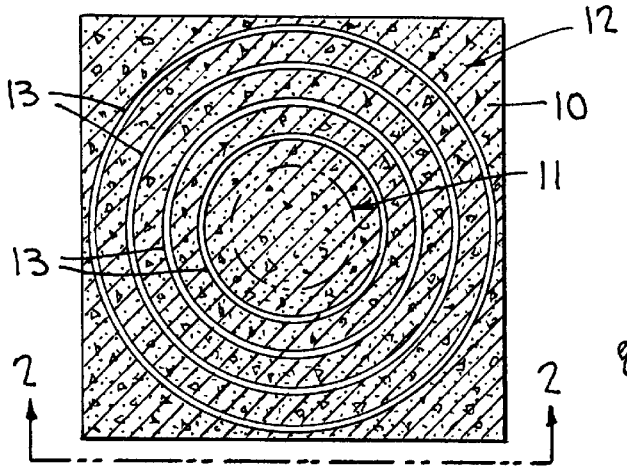
FIG. 1 is a sectional view taken substantially along the line 1—1 of FIG. 2 showing a concrete slab according to one embodiment of the invention.
Figure 3:
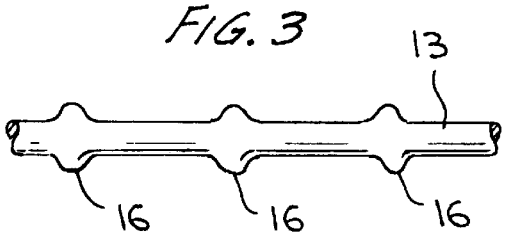
FIG. 3 is an enlarged detail view showing a portion of a typical deformed reinforcing bar utilized in the slab according to the invention.
Figure 2:
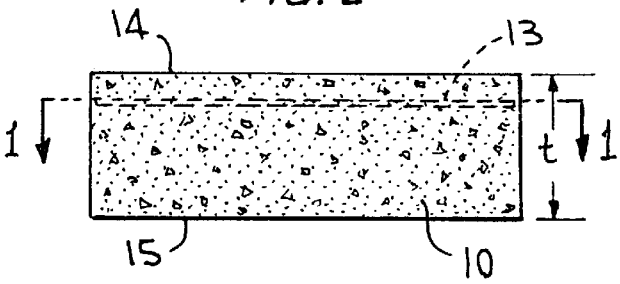
FIG. 2 is a sectional view taken substantially along the line 2—2 of FIG. 1.

Turning now to the drawings wherein like reference characters referred to like and corresponding parts throughout the several views, a reinforced concrete building structure in the form of a shrinkage compensating concrete slab 10 is shown in FIGS. 1 and 2 of generally rectangular shape although other shapes are possible, the slab being of a predetermined thickness t shown in FIG. 2. The slab has a centroid portion 11 generally illustrated in dotted outline which is surrounded by a peripheral portion 12. As normally occurs, the shrinkage compensating concrete slab actively expands and shrinks outwardly from its centroid portion such that forces are additively accumulated into the peripheral portion. In accordance with the invention, a plurality of deformed reinforcing bars 13 are embedded within the concrete slab and lie substantially parallel to the major outer and inner faces 14 and 15 of the slab shown in FIG. 2. The reinforcing bars are typically deformed as shown, for example, in FIG. 3 having spaced peripheral ribs or ridges 16 along the length thereof. The plurality of reinforcing bars 13 lie in at least one plane and are spaced from outer surface 14 a distance equal to about one-third the thickness t of the slab. The deformed reinforcing bars are neither post-tensioned nor pre-tensioned, thereby avoiding the otherwise additional cost of post- or pre-tensioning as required for many prior art Portland cement concrete slabs.

The plurality of reinforcing bars according to the invention are restricted to peripheral portion 12 and are aligned tangentially to the expansive and shrinkage forces (not otherwise shown but fully understood by persons skilled in this art) located thereat to elastically restrain the forces and to thereby function as an internally developed tension ring for the slab. The reinforcing bars according to the invention likewise maximize the efficiency of the reinforcement. The centroid portion 11 of the slab is completely devoid of any reinforcing bars which are concentrated only at the peripheral portion of the slab where they are needed.

Figure 4:
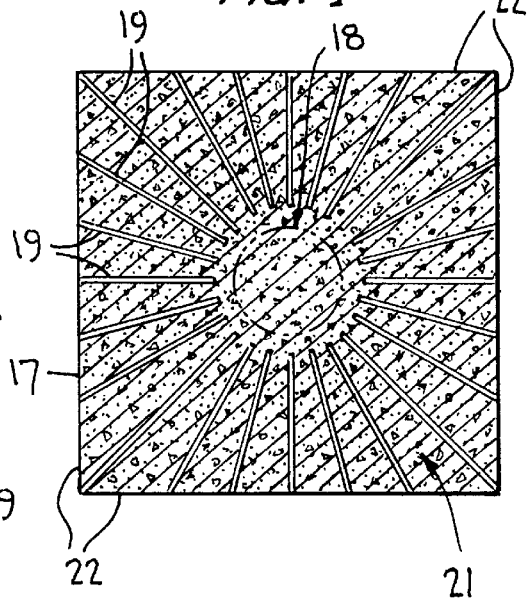
FIGS. 4, 5, 6, 7 and 8 are respectively views similar to FIG. 1 of other embodiments according to the invention.

Another embodiment of the shrinkage compensating concrete slab is shown at 17 in FIG. 4 as having its centroid portion 18 devoid of any reinforcement. The plurality of reinforcement bars 19 are restricted to peripheral portion 21 of the slab, with the bars arranged in an array radiating outwardly from centroid 18 to edges 22 of the slab and aligned with the expansive and shrinkage forces.

Figure 5:
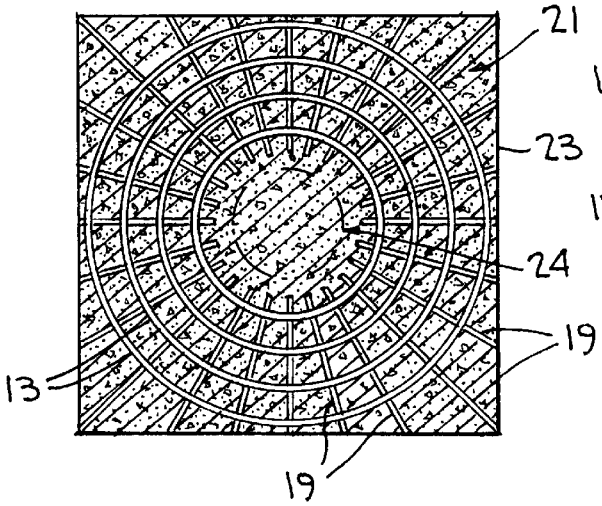

FIG. 5 is another embodiment of a reinforced shrinkage compensating concrete slab 23 according to the invention in which its centroid portion 24 is again completely devoid of any reinforcement and in which reinforcing bars 13 and 19 of the types shown in FIGS. 1 and 4 are concentrated at peripheral portion 26 of the slab.

Figure 6:
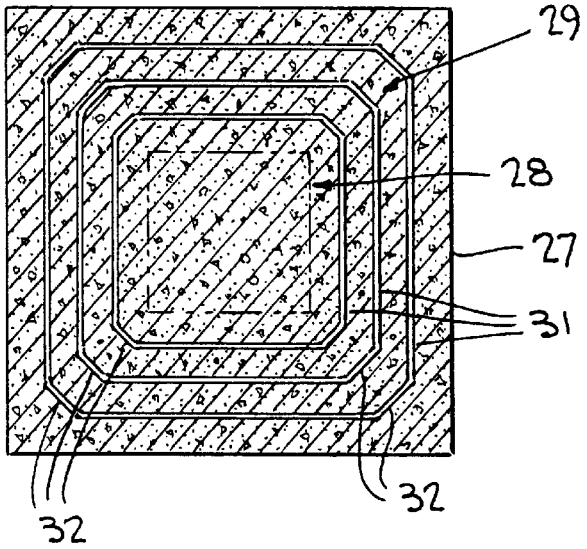

FIG. 6 shows a slab 26 according to yet another embodiment of the i invention having a centroid portion 28 devoid of reinforcement and having its peripheral portion 29 at which an array of reinforcing bars 31 is located, the bars being uniformly spaced and being substantially rectangular except for chamfered corners as at 32.

Figure 7:
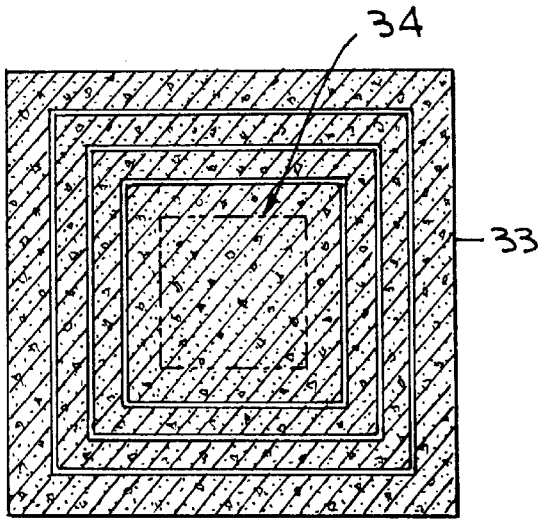

FIG. 7 shows a slab 33 of yet another embodiment according to the invention as having its centroid portion devoid of any reinforcement and as having its plurality of reinforcement bars 35 restricted to peripheral portion 36. The bars are uniformly spaced apart and are formed in an array of concentrated rectangles.

Figure 8:
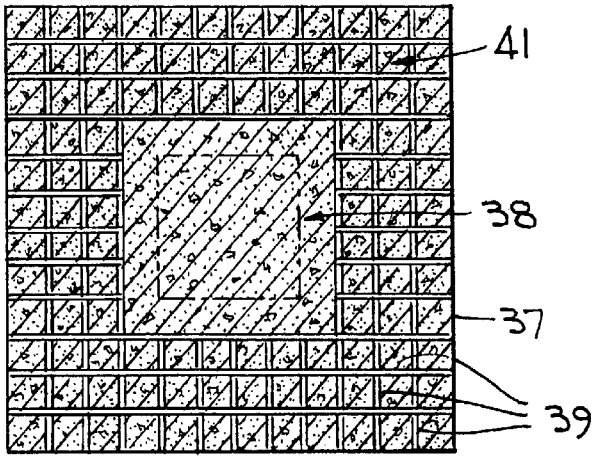

Lastly, slab 37 illustrated in FIG. 8 is yet another embodiment according to the invention which has its centroid portion 38 devoid of any reinforcement and which has its peripheral portion 41 at which are located a plurality of reinforcement bars 39 which are uniformly spaced apart and which lie parallel and perpendicular to one another.

As can be seen a shrinkage compensating concrete slab is reinforced by a plurality of deformed reinforcing bars embedded in the concrete slab and concentrated in the peripheral portion thereof which surrounds the centroid portion so as to be aligned with and tangential to the expansive and shrinkage forces at the peripheral portion to elastically restrain the forces and to thereby act as an internally developed tensioned ring. The reinforced shrinkage compensating concrete slab according to the invention is a distinct improvement over the prior art reinforced concrete slabs, the slabs of the invention making it possible to maximize the bar reinforcement efficiency, minimize labor costs during fabrication, and enhance the seamless surface area of the slab. The slab according to the invention actively changes volume against a passive, yet resilient, restraint offered by the deformed reinforcing bars which need not be either post-tensioned or pre-tensioned thereby further providing cost savings of labor, equipment, and materials. The interior portion or centroid of the slab need not directly be restrained, except by virtue of the presence of the plurality of reinforcing bars which function as an internally developed tension ring. The elastic restraint is configurable by thickening, lengthening, or respacing so to provide sufficient resilient restraint against expansion. The center of the slab is unreinforced. And, when a non-uniformly thick shrinkage compensating concrete slab structure, the elastic restraint provided in accordance with the invention is such that the reinforcement bars are thickened, lengthened or re-spaced to account for slab thickness eccentricities. The plurality of reinforcement bars in accordance with any of the various arrays shown by the various drawing by lie in a single plane or may lie in a plurality of planes, but are not uniformly distributed across the slab within length as otherwise required by the prior art reinforcement slabs. The plurality of reinforcement bars arranged according to the invention provides uniformly of distribution about the centroid and are concentric with the centroid of the slabs. Also, the deformed reinforcing bars can be of any material having a modulus of elasticity that would serve as a substitute for the standard steel bars.

Obviously, many other modifications and variations of the invention are made possible within the light of the above teachings. It is therefore to be understood that within the scope of the appended claims the invention may be practiced otherwise than as specifically described.

What is claimed is:

1. A reinforced concrete building structure comprising a shrinkage compensating concrete slab of predetermined thickness having a centroid portion surrounded by a peripheral portion, active expansive and shrinkage forces being normally concentrated in the peripheral portion, a plurality of non-post-tensioned and non-pre-tensioned, deformed reinforcing bars embedded within the concrete slab and lying substantially parallel to major outer and inner faces of the slab, the bars being spaced from the. outer surface of the slab a distance equal to about one-third the thickness of the slab, and the plurality of reinforcing bars being restricted to the peripheral portion and being aligned with the expansive and shrinkage forces to elastically restrain the forces and to maximize the efficiency of the reinforcement and to thereby act as an internally developed tension ring.

2. The structure according to claim 1, wherein the plurality of reinforcing bars lie in at least one plane.

3. The structure according to claim 1, wherein the bars are uniformly spaced apart and lie in an array of concentric circles.

4. The structure according to claim 1, wherein the bars are uniformly spaced apart and lie in an array of bars radiating from the centroid to side wall edges of the slab.

5. The structure according to claim 1, wherein the bars are uniformly spaced apart and wherein first and second sets of bars are provided, the first set radiating from the centroid to side wall edges of the slab and the second set lying in an array of concentric circles.

6. The structure according to claim 1, wherein the bars are uniformly spaced apart and lie in an array of concentric rectangles.

7. The structure according to claim 6, wherein corners of the rectangles are chamfered.

8. The structure according to claim 1, wherein the bars are uniformly spaced apart and lie parallel and perpendicular to one another.

9. The structure according to claim 1, wherein the bars are installed so as to maintain a constant surface area, or volume, of concrete therebetween.

* * * * *